United States Patent [19]

Owsianny

[11] 4,405,283

[45] Sep. 20, 1983

[54] GAS TURBINE CONSTRUCTION AND METHOD OF CONTROLLING THE LABYRINTH SEAL CLEARANCE AUTOMATICALLY AND CONTINUOUSLY

[75] Inventor: Edmund Owsianny, Oberhausen, Fed. Rep. of Germany

[73] Assignee: M.A.N. Maschinenfabrik Augsburg-Nurnberg Aktiengesellschaft, Fed. Rep. of Germany

[21] Appl. No.: 274,379

[22] Filed: Jun. 17, 1981

[30] Foreign Application Priority Data

Jun. 19, 1980 [DE] Fed. Rep. of Germany ..... 3022861

[51] Int. Cl.[3] ..... F01D 25/16; F01D 25/28

[52] U.S. Cl. ..... 415/14; 415/33; 415/119; 415/219 R; 248/DIG. 1

[58] Field of Search ..... 415/1, 14, 119, 171, 415/33; 277/28, 54, 55, 192; 248/DIG. 1, 188.2, 188.5, 650

[56] References Cited

U.S. PATENT DOCUMENTS

| | | | |
|---|---|---|---|
| 1,168,273 | 1/1916 | Banner | 277/54 X |
| 3,052,123 | 9/1962 | Gustafson | 29/407 X |
| 3,161,389 | 12/1964 | Beine | 248/646 |
| 3,250,503 | 5/1966 | Karstens | 248/649 |
| 3,464,654 | 9/1969 | Kolesar | 248/188.2 X |
| 3,516,757 | 6/1970 | Baumann | 415/112 |
| 3,642,295 | 2/1972 | Cohen | 415/171 |
| 3,764,098 | 10/1973 | Dickinson | 248/542 |
| 3,799,482 | 3/1974 | Bellati et al. | 415/219 R X |
| 3,999,766 | 12/1976 | Barton | 277/28 |
| 4,170,364 | 10/1979 | Remberg et al. | 277/192 X |
| 3,632,117 | 1/1972 | Villasor | 277/28 X |

FOREIGN PATENT DOCUMENTS

| | | | |
|---|---|---|---|
| 2557805 | 6/1977 | Fed. Rep. of Germany . | |
| 2710706 | 9/1978 | Fed. Rep. of Germany | 415/171 |
| 2717617 | 9/1978 | Fed. Rep. of Germany . | |
| 52-57411 | 5/1977 | Japan | 415/14 |
| 54-121402 | 9/1979 | Japan | 415/171 |
| 212270 | 11/1940 | Switzerland . | |

*Primary Examiner*—Philip R. Coe
*Assistant Examiner*—Frankie L. Stinson
*Attorney, Agent, or Firm*—McGlew and Tuttle

[57] ABSTRACT

A flow machine particularly a superheated gas turbine comprises a housing with a rotor disposed in the housing for rotation therein and sealed at each end with the housing by a labyrinth seal. The construction includes rotor shaft bearings which rotatably support the shafts and which are supported by bearing blocks disposed on the foundation. The housing and the shaft are mounted relative to each other by means of fluid pressure operated cushions adjacent each end of the shaft and adjacent the labyrinth seal so as to maintain the shafts and the seals with a predetermined clearance.

6 Claims, 6 Drawing Figures

GAS TURBINE CONSTRUCTION AND METHOD OF CONTROLLING THE LABYRINTH SEAL CLEARANCE AUTOMATICALLY AND CONTINUOUSLY

FIELD AND BACKGROUND OF THE INVENTION

This invention relates in general to turbines and in particular to a new and useful construction and method for maintaining a uniform clearance of labyrinth seals arranged at each end of a rotatable turbine shaft.

The invention relates to a flow machine, in particular a superheated gas turbine, the machine housing of which is equipped on both sides with a labyrinth seal sealing the rotor shaft by means of a sealing fluid, and to controlling the labyrinth seal clearance automatically and continuously.

Several and different problems regarding the housing and rotor shaft mounting occur in such machines, and numerous attempts to avoid or remedy the known difficulties have not been lacking.

In single housing flow machines, and even more so in machines having two or more housings, such as turbines or compressors, the problem of providing an adjustment possibility for the housing parts to make their exact and simple alignment possible crops up even when aligning the housing parts in assembly.

Another problem encountered in such machines also is that sometimes changes in the foundations, such as settling of the floor, take place, which can effect the precise horizontal alignment of the machine or machine aggregates. In such cases a realignment must be carried out which often is associated with considerable engineering expense.

Securing exact centering and maintaining the clearances when heat expansions of the machine occur represents a very serious problem. For example, to make readjustments of housing parts possible, it is suggested in DE-AS No. 12 89 535 to support these parts relative to each other by means of adjusting screws and exchangable shims of varying thickness. Another, similar suggestion made in the German design patent No. 71 24 691 relates to the same problem and shows an arrangement of spherical adjusting parts in conjunction with height adjustable immersion nuts.

The aligning problem, in particular of machine sets with several housings, is also the basis of German patent DE-AS No. 23 25 642, the object of which is the facilitation or improvement of the relative alignment of the power turbine rotor in the power turbine housing. Proposed for this purpose is suspending the turbine from two trunnions and having the gas generator supported by a movable support structure. A similar suspension is also shown in German patent DE-OS No. 26 17 024. Therein, the turbine stator housing is suspended so as to be freely expandable from flanges of the outer engine housing by means of radially oriented bolts.

The axial alignment of a multihousing or multiunit machine set such as a turbo group consisting of a helium high temperature turbine with a compressor and a generator involves special difficulties. According to DE-OS No. 27 17 617 it is suggested that there be disposed between the foundation and the turbo-group height-adjustable and axially movable supports which should engage lateral claws of the turbo group and be height-adjustable hydraulically or mechanically. At least four such height-adjustable supports are provided for each machine housing. Such an arrangement makes it possible to align the housings of several machines belonging to a turbo group axially and also to readjust this alignment when needed.

Apart from the difficulties of aligning such flow machines in assembly as discussed in the above publications, or also the difficulties of the misalignments developing in the course of operation as well as the further problem, particularly occurring in flow machines highly stressed thermally, and also of the difficulties involved due to the possibility of tensions and impermissable changes in the required clearances resulting from thermal stress of housing and subassembly components, an additional difficulty exists that adequate vibration damping in such machines, taking into account varying operating conditions, is often unattainable when the known bearing arrangements are employed.

SUMMARY OF THE INVENTION

The invention provides for such flow machines, in particular those highly stressed thermally, a bearing design which avoids the above described problems in a satisfactory manner. The invention comprises a flow machine, in particular a superheated gas turbine, the machine housing of which is equipped on both sides with a labyrinth seal sealing the rotor shaft by means of a sealing fluid. In accordance with a feature of the invention, the machine housing is mounted independently of the bearings on the inlet and outlet side in the area of the rotor shaft which are supported by bearing blocks disposed on the fondations. The machine housing is mounted, on volume-variable, hydraulic pressure medium cushions so as to be height-adjustable relative to the rotor shaft. This mounting of the machine housing on volume-variable, hydraulic pressure medium cushions makes possible stepless, fine adjustment and alignment of the machine housing and, in addition, acts excellently to affect vibration damping. Furthermore, it makes it possible to adapt the machine housing mounting to deformations due to thermal stress on the machine.

Moreover, according to the invention, the machine is height-adjustably mounted to the foundation via traverses by means of carrying sleeves supported by hydraulic pressure cushions, the hydraulic cushions being disposed in annular slots formed between the carrying sleeves and the supporting sleeves guided with clearance on staybolts. The sleeves carrying the machine housing are height adjustably guided in tubular holding means enclosing the staybolts with little clearance and being supported on the bearing block by means of self-aligning, spherical bearings formed of ball socket and ball head. Advantageously, at least one each hydraulic pressure cushion enclosed in a sealed annular chamber equipped with separate fluid inlet and outlet lines is disposed on top of each other between each supporting sleeve and the sleeve carrying the machine housing and enclosing the supporting sleeve.

Through this design and arrangement of the hydraulic pressure cushions the further advantage is achievable, in particular, that a better fine adjustment of the labyrinth seal clearance is possible, whereby a considerable amount of sealant can be saved which would be required if the sealing gap were enlarged because of the necessarily greater radial clearances of the stuffing boxes.

It is further proposed, according to the invention, also to support the rotor shaft bearing blocks so as to be height-adjustable relative to the foundation by means of volume-variable, hydraulic pressure cushions. This arrangement, together with the hydraulic mounting of the machine housing, facilitates greatly the adjustability of these parts relative to each other and in a horizontal position and to align them with any other machine units possibly present of a turbo group. Furthermore, the vibration damping of both the housing and the turbine rotor is substantially improved. The turbine runs more smoothly and the foundation is relieved of vibratory stress. Even when changes in shape and position of the foundation itself occur, the ideal position of the machine housing and of the turbo rotor can always be established without difficulties due to the twin adjustment possibilities of the hydraulic pressure cushion mounting.

A second object of the invention is a method for the automatic, continuous control of the labyrinth seal clearance of such a flow machine, in particular of a superheated steam turbine. According to the inventive method, the variation of the sealing gap between rotor shaft and labyrinth seal, which variation is caused by changing operating conditions, is measured continuously by sensors disposed at the inlet and outlet side of the machine. The value measured serves, via an amplification system, as a control signal for the actuation of one or more hydraulic cylinder/piston units through which part quantities of the pressure medium are fed to or drained from the hydraulic cushions, thereby keeping the labyrinth sealing gap centered and constant as a function of the prevailing operating conditions by raising or lowering the machine housing relative to the rotor shaft.

Due to this procedure, the deformation resulting from changing operating conditions and the thermal stress of the machine caused thereby are automatically and continuously compensated by appropriate machine housing adjustment so that the labyrinth seal clearance required and, hence, the radial clearances of the stuffing boxes can be kept very close, resulting in considerable sealing fluid savings. The respective gap change between rotor and labyrinth seal is continuously measured by sensors at the labyrinth seals on the inlet and outlet side. The value measured is utilized, via an amplification system of any kind and known per se, as a control signal for the actuation of pressure medium cylinder/piston units in order to raise or lower the hydraulic cushions by adding to them or subtracting from them part amounts of pressure medium, thereby effecting a correction of the housing position continuously in accordance with the prevailing operating conditions.

Accordingly, it is an object of the invention to provide a flow machine and particularly a superheated gas turbine which comprises a housing with a rotor disposed in the housing for rotation therein and having a labyrinth seal adjacent each end of the rotor sealing the rotor with the housing between the seals and with bearing part means adjacent said rotor and said housing rotatably supporting said rotor and fluid pressure operated cushions connected between the housing and the rotor which act independently of the bearing block means for adjusting and holding the housing and the rotor at locations adjacent said labyrinth seal so as to provide a predetermined sealing clearance thereof.

A further object of the invention is to provide a method of controlling a labyrinth seal clearance at one or more locations along a rotatable shaft such as a gas turbine which comprises supporting the housing for the shaft and the rotor independently of any bearings thereof on adjustable supporting cushions, and continuously measuring the sealing gap clearance adjacent the respective labyrinth seals and by fluid pressure adjusting the position of the rotor relative to the housing to maintain a predetermined sealing clearance.

A further object of the invention is to provide a fluid engine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figures 2, 3:
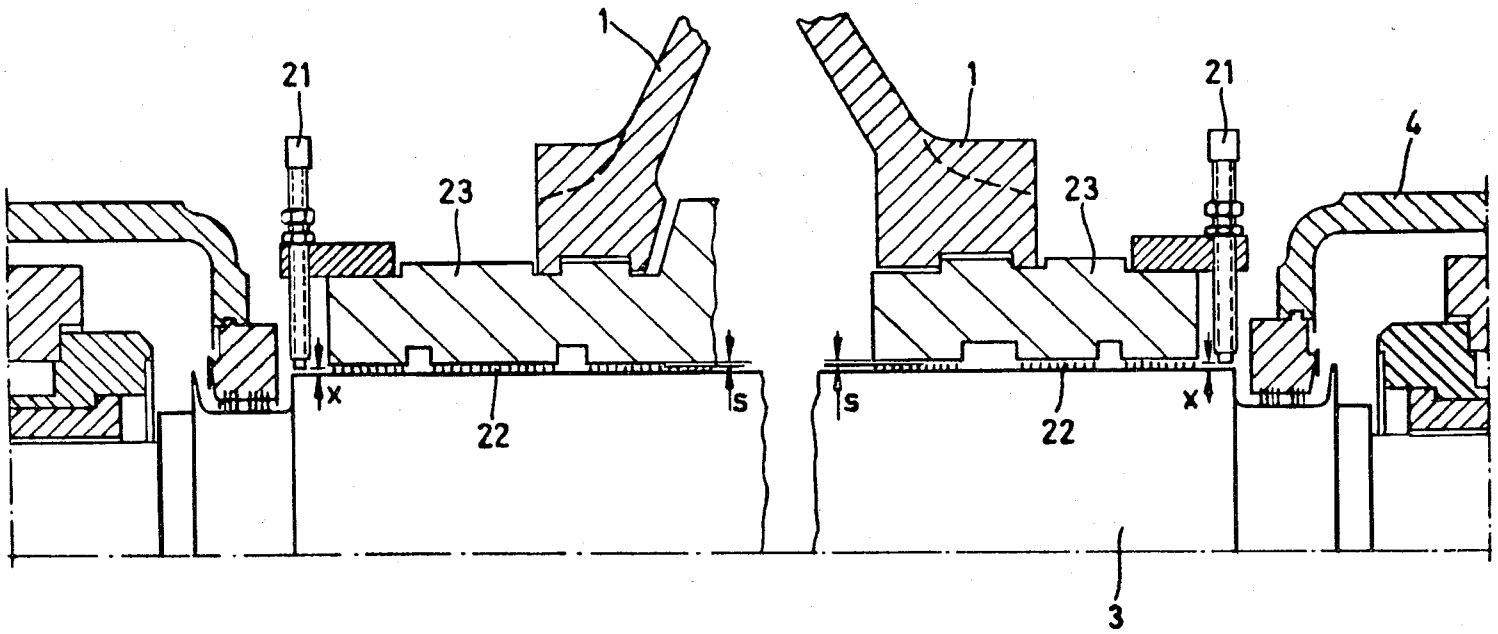
FIG. 2 is an enlarged partial detail of a portion of the turbine shown in FIG. 1.
FIG. 3 is a view similar to FIG. 2 showing the other end of the turbine from that shown in FIG. 2.

Referring to the drawings in particular, the invention as embodied therein comprises a flow machine particularly a superheated gas turbine having a turbine housing generally designated 1 with a turbine rotor 3 disposed in the housing for rotation therein. A labyrinth seal 22 as shown in FIGS. 2 and 3 are arranged at respective ends of the rotor 3 and seal the rotor with the housing between the seals of the labyrinth seal by having sealout supplied thereto under pressure. Bearing block means comprising a bearing block 5 and a shaft bearing 4 rotatably support respective ends of the shaft 3. In addition, fluid pressure operated cushion system generally designated 7 which are connected between the housing 1 and the rotor 3 and acting independently of the bearing block means adjustably hold the housing and the rotor adjacent the labyrinth seal so as to provide a predetermined sealing clearance of the seals.

Figure 1:
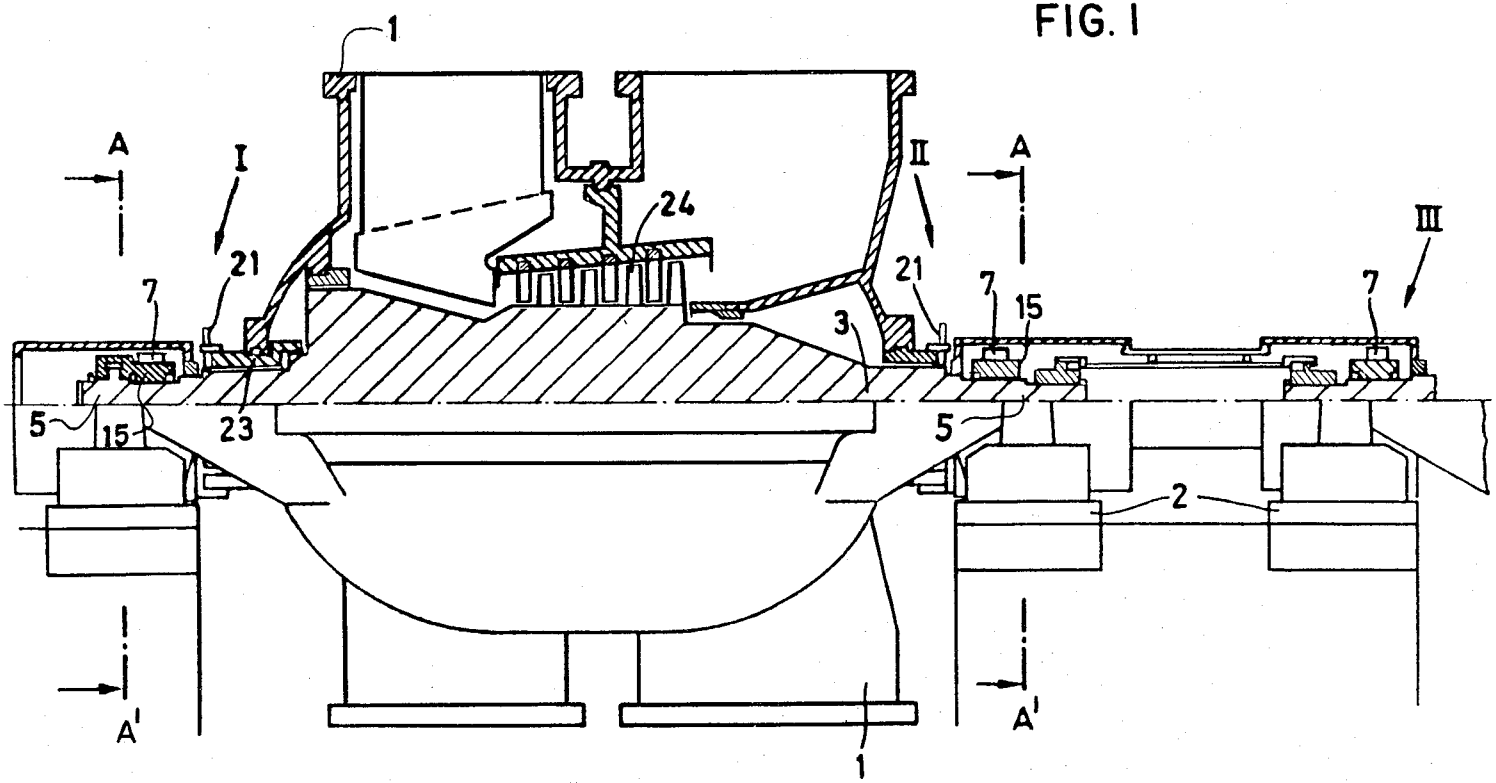
FIG. 1 is an axial sectional view of a fluid flow engine constructed in accordance with the invention.

In FIG. 1 is shown a machine housing 1 of a turbo group, its upper part being shown as a longitudinal section, its lower part as longitudinal side elevational view. Also shown are the bearing points on the inlet and outlet side, designated I and II, respectively, and a bearing point III of the succeeding machine housing.

In FIG. 1, 3 is the rotor shaft while 24 is the rotor, sketched only. The traverse 15 supports the machine housing 1 in a manner not detailed. Also indicated are the stuffing boxes 23, the sensors 21 and the base plates 2. Hydraulic pressure cushion systems generally designated 7 support the traverses and with them the machine housing 1.

The features of the mounting of the machine housing 1 are depicted in FIGS. 2 and 3 which show details at the inlet and outlet sides. The machine housing 1 supported by a traverse or support member 15 which (FIGS. 4,5) is suported so as to be hydraulically height-adjustable relative to a bearing block 5. The rotor shaft 3 is sealed by means of labyrinth seals 22, the sealing gap s of which is to be kept constant in all operating conditions of the machine. To achieve this, the invention provides an automatically acting labyrinth seal clearance adjustment in which the measured value x is sensed by a sensor 21 disposed on the respective inlet and outlet sides adjacent the heat-elastic labyrinth seal 22. These sensors 21,21 constantly measure the gap change x between the rotor and the seal. The measured value x is transmitted, according to the invention, to a hydraulic support system 7 by means of a transmission system (FIG. 6) so that additional pressure medium is fed to or drained from the adjustable hydraulic cushions or sleeves 8' (FIG. 5) which are movably adjustable in cylinders 8'' to compensate the gap variations.

Figure 4:
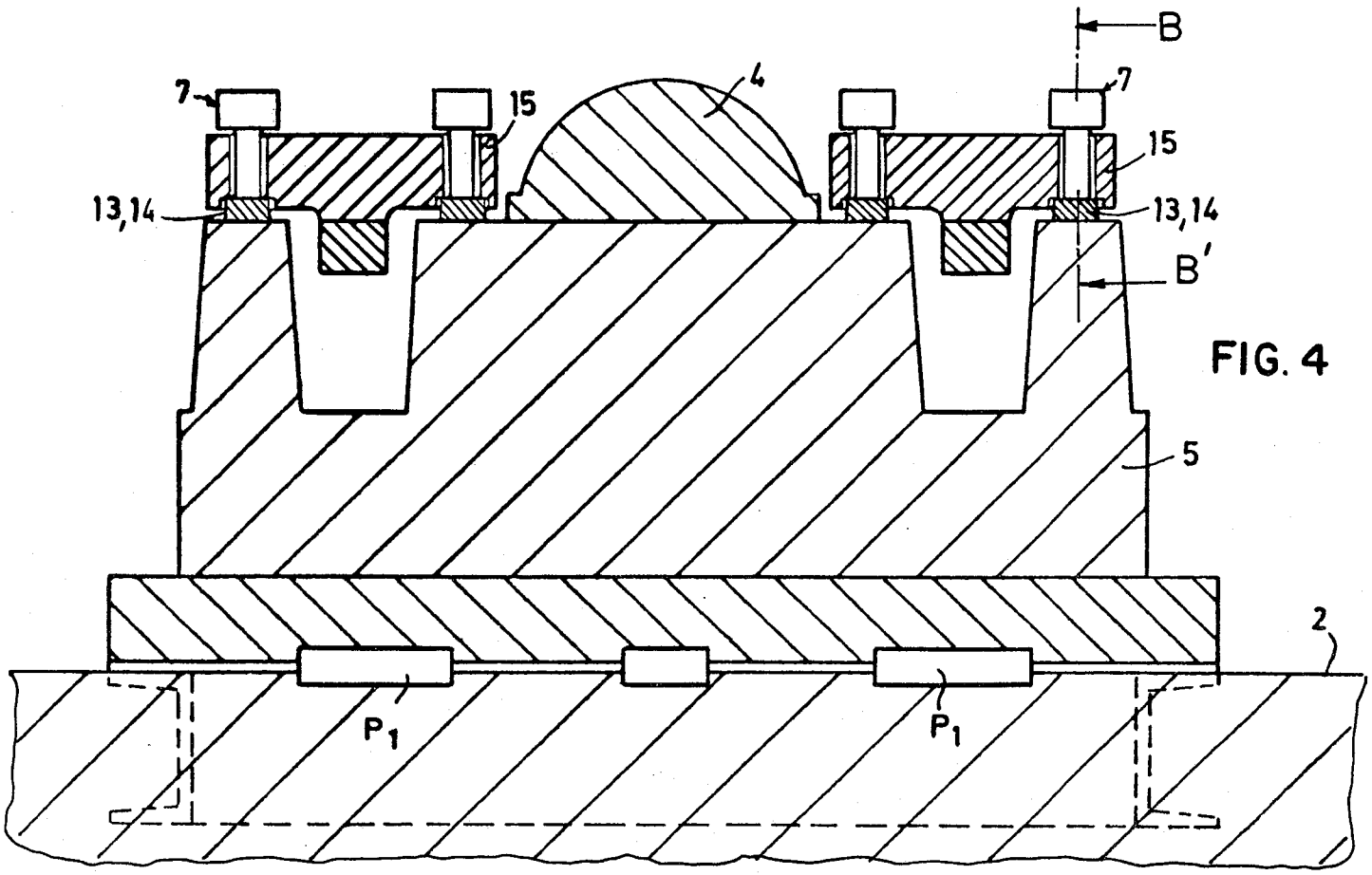
FIG. 4 is a section taken along the line A—A' of FIG. 1.
Figure 5:
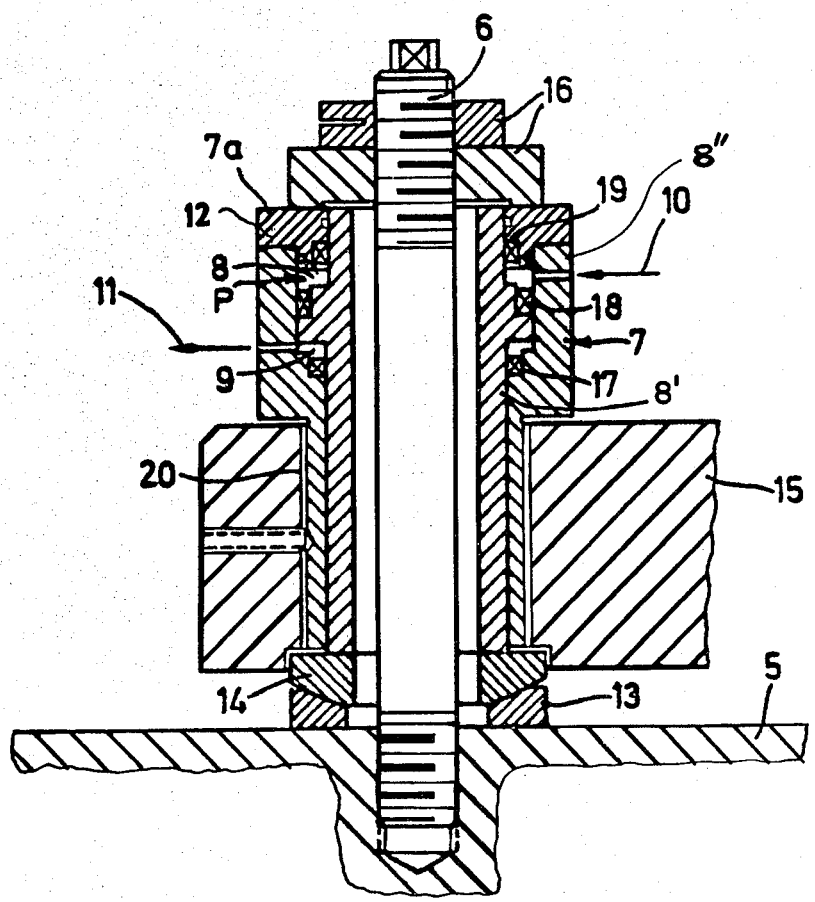
FIG. 5 is a section taken along the line B—B' of FIG. 4.

Further details of the arrangement of the support system 7' are shown in FIGS. 4 and 5. The bearing block 5 is supported by hydraulic cushions P1 similar to cushions 8' which are enclosed in cylinders for vibration damping. The bearing block 5 supports the rotor shaft bearing 4. Also disposed on the bearing block 5 on both sides of the rotor shaft bearing 4 by means of the hydraulic pressure medium support according to the invention are the two traverses 15 which support the machine housing 1 in a manner not shown. The hydraulic pressure cushion supports 7 are indicated in FIG. 4 by a pivot or ball and socket 14 and 13 for the pivotal mounting of system 7. Details of the support systems are evident from FIG. 5.

Each one of the traverses 15 shown in FIG. 4 is held by two hydraulic pressure cushion support systems 7, each as shown in FIG. 5. The cylinder 8'' is screwed into the traverse 15 by means of thread 20. The cylinder 8'' is closed by the cover 7*a* and supported by the support sleeve 8' via the pressure cushion P enclosed in the annular chamber 8. The annular chamber 8 is sealed against the support sleeve 8' by the seals 18, 19. A line 10, by means of which fluid fed to or drained from the annular chamber 8 ends in the latter.

The support sleeve 8' is guided by the staybolt 6 which is screwed into the bearing block 5. The support sleeve 8' is supported in self aligning fashion by the bearing block 5 via the ball socket 13 and ball head 14 resting on the bearing block 5. Also provided is an annular chamber 9 which is sealed against the support sleeve 8' by means of the seal 17. Fluid which may leak from chamber 8 collects between the carrying sleeve 8' and the cylinder 8'' and is carried away through line 11. Staybolt 6 has a locknut arrangement 16 at the top thereof to limit relative upward motion of sleeve 8' with respect to cylinder 8''.

Figure 6:
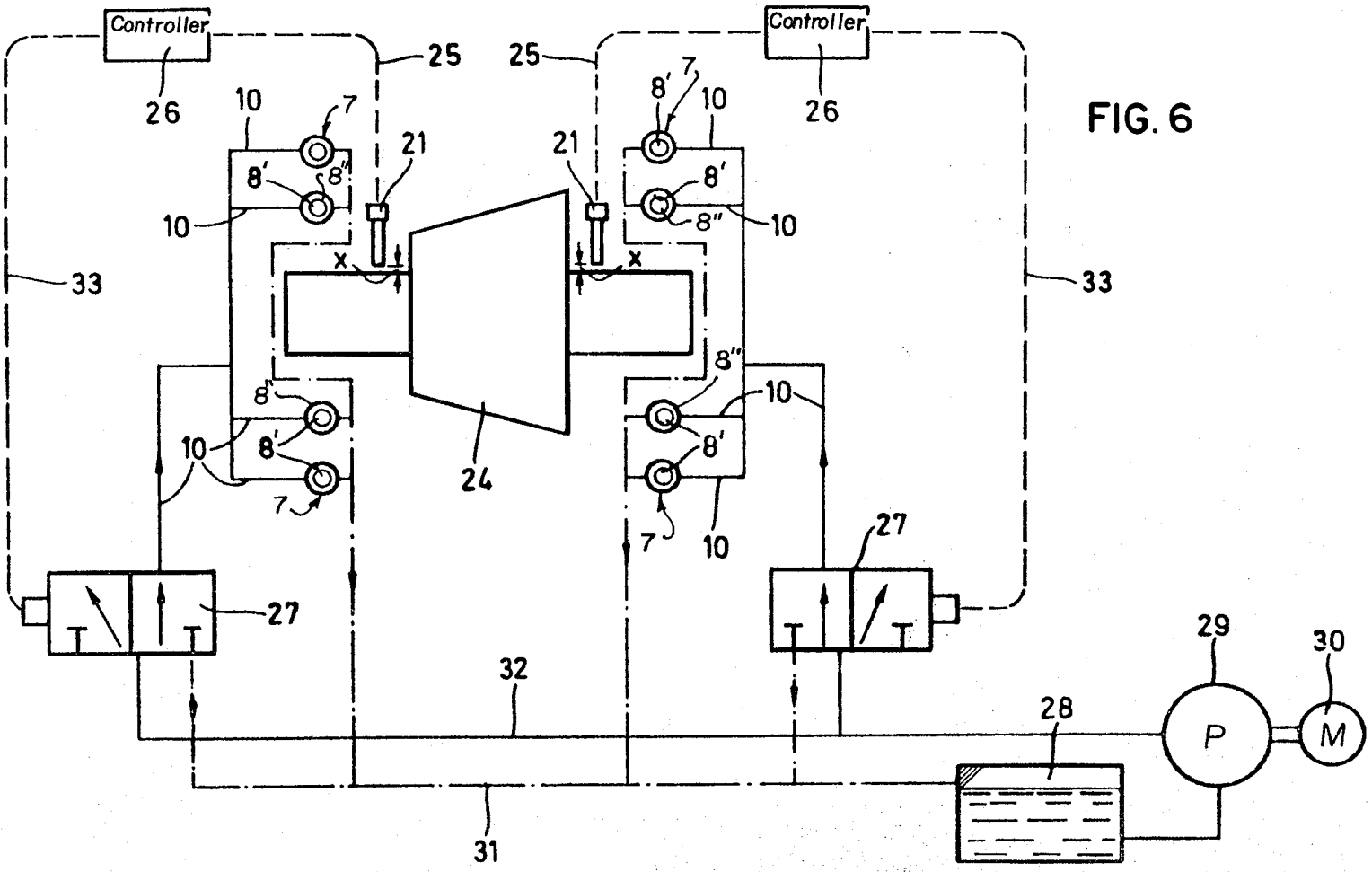
FIG. 6 is a diagram of the arrangement of the fluid operated sealing supports for the turbine.

Shown in FIG. 6 as an example is an electrohydraulic arrangement for the implementation of the automatic sealing gap size control. The dimension x is continuously measured by the sensors 21 on the inlet and outlet sides as deviation from a set theoretical value by scanning the rotor shaft, and transmitted as control signals via the lines 25 to the position controllers 26 which process the control signals. From there, the inlet or outlet of pressure medium via the lines 10 to the annular chambers 8 containing the pressure medium cushions P is controlled via the lines 33 and the electrohydraulic transducers 27. In the embodiment example, the pressure is generated by a motor-driven pressure medium pump 29, 30, aspirated from the supply tank 28 and fed to the electrohydraulic transducers 27 via the lines 32 and returned to the tank 28 through the lines 31.

While specific embodiments of the invention have been shown and described in detail to illustrate the application of the principles of the invention, it will be understood that the invention may be embodied otherwise without departing from such principles.

What is claimed is:

1. A hot gas turbine to be supported on a foundation, comprises:

a housing defining a rotor space;

a rotor rotatably mounted to said housing and in said rotor space, said rotor connected to a rotor shaft extending out of said rotor space from two opposite sides of said housing;

a rotor shaft bearing having a bearing block connected to said rotor shaft at each of said opposite sides of said housing and outside said rotor space, each bearing block adapted to be supported by the foundation;

a labyrinth seal connected between said rotor shaft and said housing at each opposite side of said housing, to which a pressure sealant is supplied for sealing said rotor space, each labyrinth seal having a clearance gap between said rotor shaft and said housing;

at least one traverse connected to said housing and extending to one of said bearing blocks on each opposite side of said housing;

a cushion cylinder connected to each traverse;

cushion support sleeve movable in each cylinder and each engaged on a bearing block, said sleeve and cylinder defining an annular cushion space therebetween; each cushion space being changeable in volume to adjust a distance between said traverse and an adjacent bearing block and thereby adjust said clearance gap on each side of said housing;

staybolt means connected to each bearing block and extending over each respective sleeve for limiting relative motion of each sleeve with respect to each traverse;

sensor means associated with said housing at each opposite side thereof for sensing an actual amount of each clearance gap;

fluid pressure means connected to each annular cushion space for selectively pressurizing and venting each cushion space; and control means connected to each sensor means and to said fluid pressure means for controlling said fluid pressure means to change said actual clearance gap to a selected clearance gap, in response to a signal corresponding to the actual amount of each clearance gap from each sensor means.

2. A high temperature turbine according to claim 1, wherein said control means comprises a controller connected to each sensor means and a fluid valve connected between said fluid pressure means and each annular cushion space, each controller connected to one of said valves.

3. A hot gas turbine according to claim 1, including a self-adjusting spherical bearing connected between each bearing block and engaging cushion support sleeve, said self-adjusting spherical bearing comprising a spherical socket connected to said bearing block and a spherical head connected to said sleeve.

4. A hot gas turbine according to claim 1, wherein each cushion cylinder and sleeve movable therein define an additional annular cushion space below said first-mentioned annular cushion space, a seal between said first-mentioned additional cushion spaces and means connecting said additional annular cushion space with said fluid pressure means for returning fluid which leaks out of said first-mentioned cushion space and to said additional cushion space, and back to said fluid pressure means.

5. A hot gas turbine according to claim 1, including pressure suspension cushion means connected to each bearing block and adapted to engage on said foundation for resiliently supporting each bearing block.

6. A hot gas turbine according to claim 5, wherein said pressure suspension cushion means comprise a cushion cylinder and a cushion sleeve movable in said cushion cylinder and defining an annular variable volume space therein for receiving a fluid.

* * * * *